United States Patent [19]

Lewis

[11] 4,140,097

[45] Feb. 20, 1979

[54] OSCILLATING PLATFORM FOR A BALL-THROWING DEVICE

[76] Inventor: Oliver G. Lewis, 810 Highland Ave., Westfield, N.J. 07090

[21] Appl. No.: 722,622

[22] Filed: Sep. 13, 1976

[51] Int. Cl.[2] ..... F41B 15/00

[52] U.S. Cl. ..... 124/80; 273/29 A; 124/9

[58] Field of Search ..... 124/9, 8, 32, 6, 80; 188/72.7; 308/230; 42/54, 55; 89/7, 8, 36 H, 36 K, 40 B; 273/26 D; 272/55, 146; 74/69, 88, 63, 55–57, 25; 280/47.23, 47.2

[56] References Cited

U.S. PATENT DOCUMENTS

| | | | |
|---|---|---|---|
| 1,217,047 | 2/1917 | Morris | 280/47.2 X |
| 1,296,688 | 3/1919 | Noah | 89/36 K |
| 1,546,835 | 7/1925 | Hobb | 280/47.23 |
| 1,553,528 | 9/1925 | Hartong | 272/55 UX |
| 2,660,065 | 11/1953 | Williams | 74/25 |
| 2,668,526 | 2/1954 | Woolsey | 124/9 |
| 3,421,491 | 1/1969 | Brown | 124/9 |
| 3,568,653 | 3/1968 | Earle | 124/9 X |
| 3,604,409 | 9/1971 | Doeg | 273/26 D X |
| 3,766,901 | 10/1973 | Cleary et al. | 273/26 D X |
| 3,784,193 | 1/1974 | Simjian | 272/146 X |

*Primary Examiner*—Richard C. Pinkham
*Assistant Examiner*—William R. Browne

[57] ABSTRACT

A low silhouette oscillating platform upon which may be mounted a device or machine for throwing balls to a player or players for catching or batting practice. The oscillating platform allows the pitched balls to be distributed at random within any point of a specified arc. The platform may be permanently attached to the throwing device or attached by quick-disconnect latches, thereby allowing removal for storage. The platform may be left attached to the throwing device and not electrically activated for throwing or pitching to a fixed point.

Two wheels are so affixed to the platform that, when required, they may be used to move or transport the entire assembly. The lower surface of the platform is smooth or padded to protect the surface upon which it is placed, which may be a smooth tennis court.

7 Claims, 8 Drawing Figures

OSCILLATING PLATFORM FOR A BALL-THROWING DEVICE

BACKGROUND OF THE INVENTION

Numerous devices are now marketed to provide thrown balls for batting, catching or tennis practice. This invention relates to a platform upon which such devices can be placed so as to oscillate and direct balls in different, somewhat random, directions.

SUMMARY OF THE INVENTION

A device according to this invention may have an extremely low silhouette, light weight, and a smooth undersurface that does not mar the surface upon which it is placed. It is adaptable to many types of practice devices.

In one preferred embodiment, the platform is less than 2 inches thick, which does not materially change the height of the practice device or change the center of gravity. The preferred platform embodiment comprises two short metal plates, one of which forms a smooth base, a pivot post for oscillation, and rollers to support the surface on which the pitching device is affixed. The lower platform also contains two larger transport wheels.

The upper plate or platform contains the electrical drive mechanism and electrical operating switches. The upper platform oscillates upon the lower surface at approximately its midpoint by action of a roller cam and crank affixed to the shaft of the tap-mounted electrical motor, engaging a slotted guide on the lower platform or plate. (Scotch yoke).

The drive motor running continuously and by action of the cam or Scotch yoke allows the pitching device mounted thereon to fire or pitch the balls at any point in its reciprocating transit or at random (provided the speed of a half revolution of the drive cam is not equal or synchronized with the cycle of the pitching device). The player will therefore not know where the ball will be projected. By remotely interrupting the drive motor circuit, an attendant can select the pitching point.

DESCRIPTION OF THE PREFERRED EMBODIMENT

Figure 1:
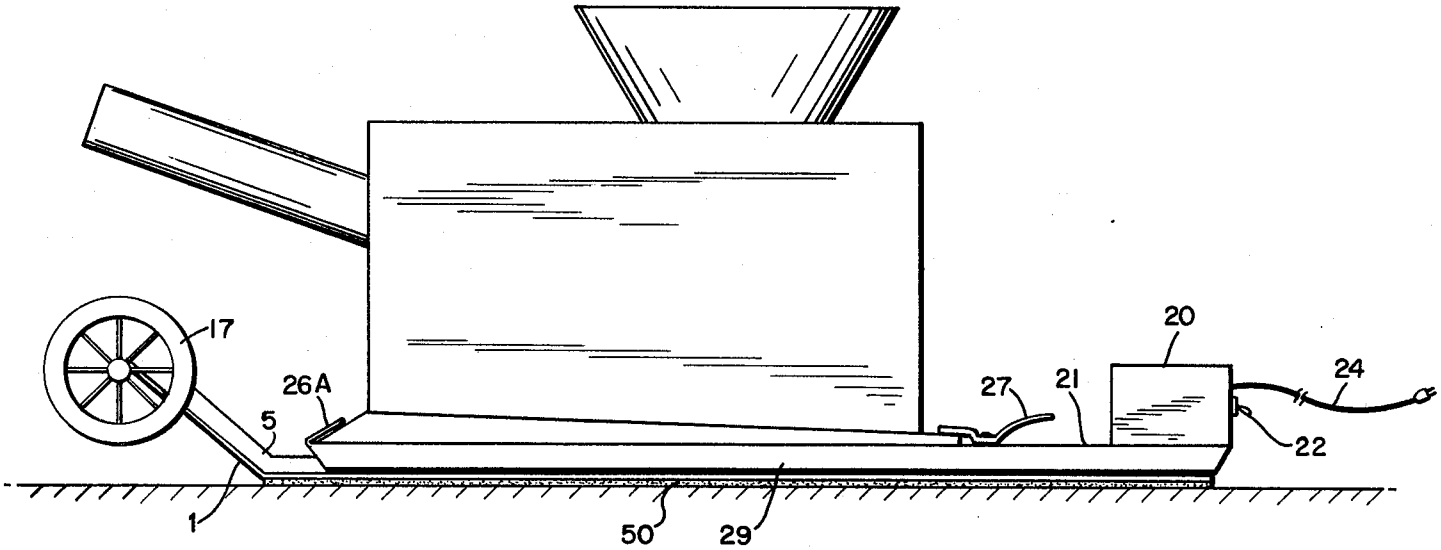
FIG. 1 is a side view of an oscillating platform according to the present invention having a conventional ball throwing machine affixed to the top plate thereof.
Figure 2:
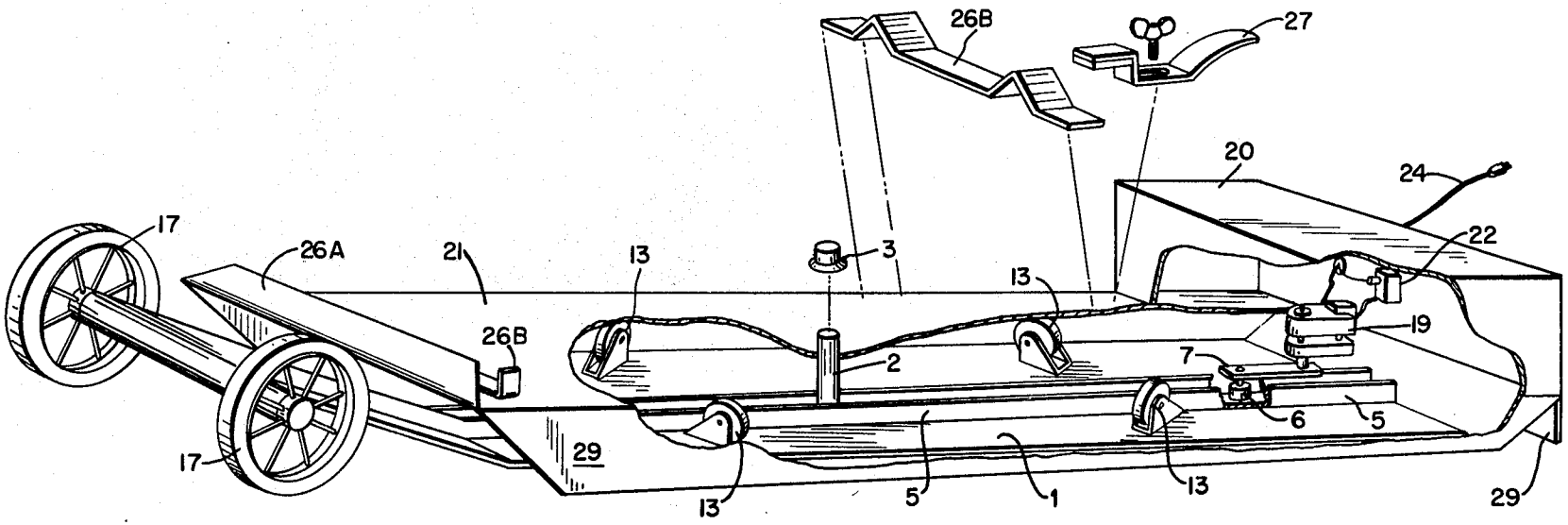
FIG. 2 is a partially exploded, partially cutaway view of an oscillating platform according to the present invention.
Figure 3:
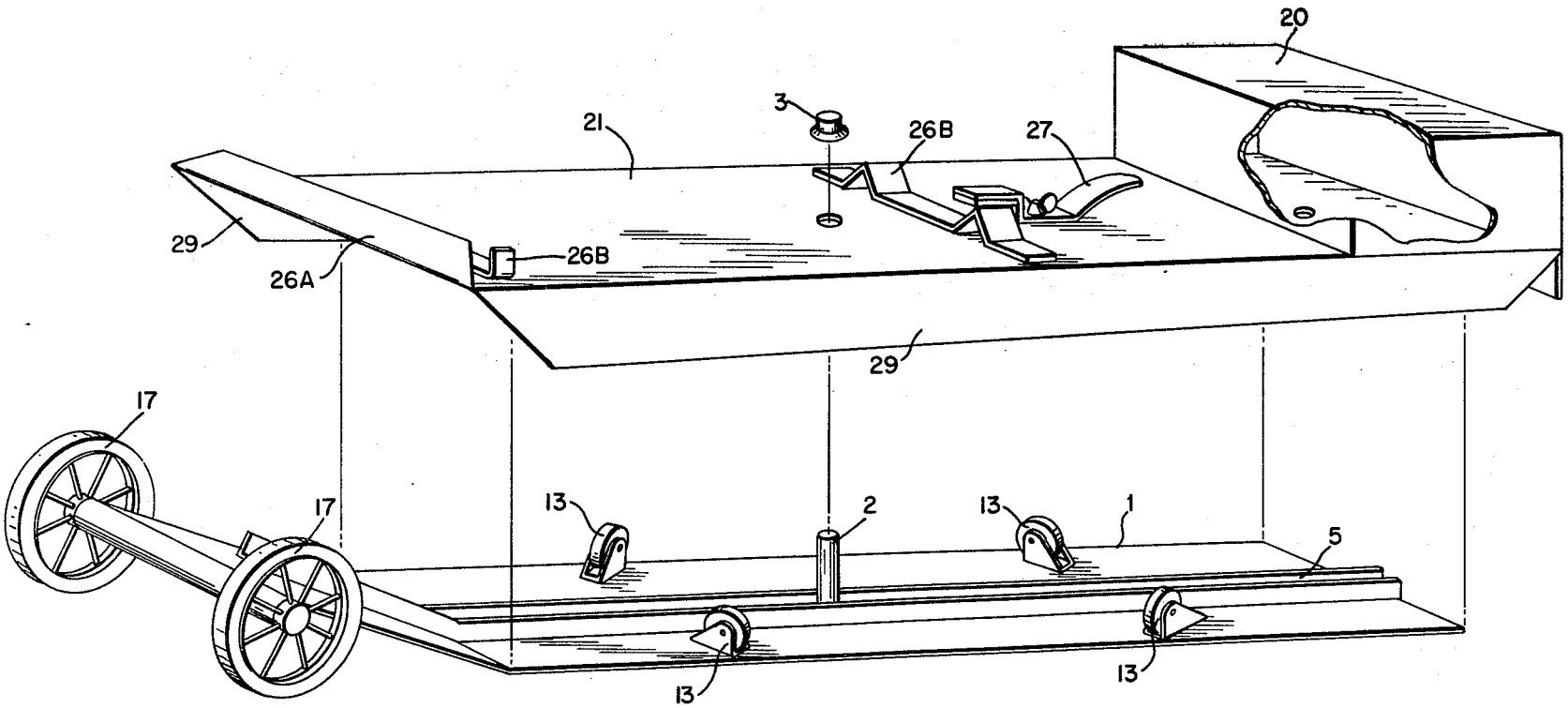
FIG. 3 is another, partially exploded, partially cutaway view of a platform according to the invention.
Figure 5:
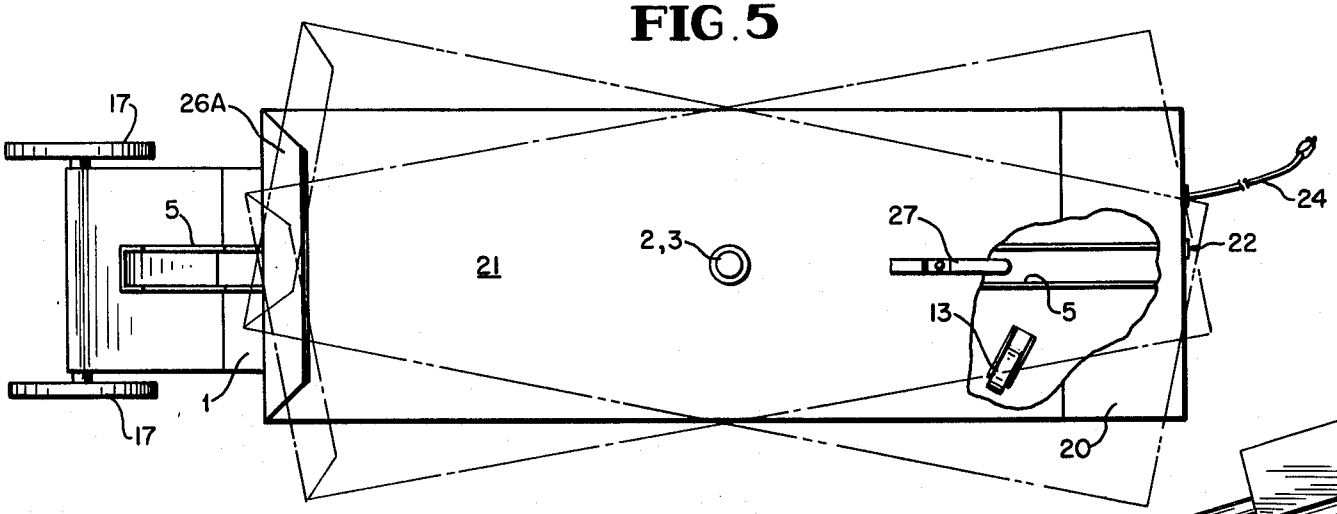
FIG. 5 is a top view of a platform showing the arc of oscillation.
Figure 4:
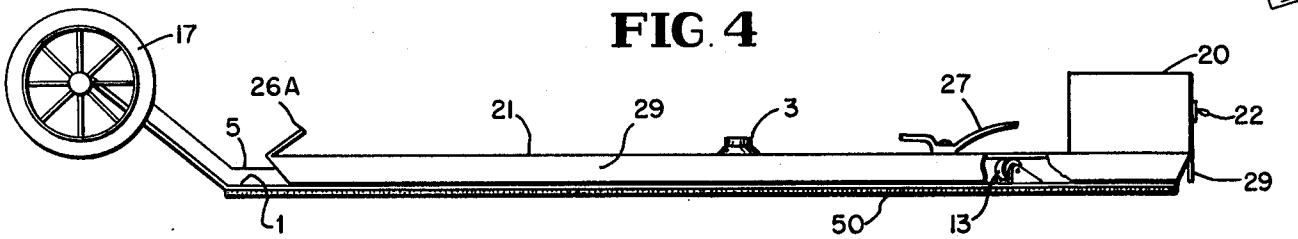
FIG. 4 is a side view of an assembled platform according to FIG. 3.

The platform assembly consists of a lower smooth undersurface plate 1 which contains a pivot post 2 protruding through a hole in approximately the midpoint of the top platform 21. The assembly is secured by a retaining device such as a press-fit cap nut 3 onto the pivot post 2. The bottom plate 1 also contains on its upper surface a crosshead or U-shaped channel 5 or other form of slot to engage the motor-driven cam roller 6. The drive motor 19 is mounted upon the upper platform with its drive shaft protruding below the platform. To this protruding drive shaft is attached a cross arm 7 containing on one end a bearing or cam roller 6. The cam roller offset (i.e., distance between the motor shaft and the axis of the cam roller) and the distance of the motor shaft from the platform pivot 2 determines the chord or arc of oscillation. Rotation of the shaft of drive-motor 19 and the cross-arm 7 causes the cam roller 6 riding in the slot 5 to move the platform 21 on an arc equal to twice the offset of the cam roller 6. The upper platform 21 is supported by four adequately dispersed rollers or casters 13 fastened to the lower plate 1. The rollers bear upon the underside of the top plate 21 so as not to be impeded by any dirt or particles which might be picked up from the playing surface. Some protection is afforded by a skirt 29 formed on the perimeter of the upper platform 21.

Transport wheels 17 are mounted upon the lower platform 1 to allow the practice device to be moved around. The wheels 17 are intentionally mounted to be slightly off of the playing surface or ground when the device is at rest. This offset or clearance is provided so that the wheels will not support the weight of the device at rest. All weight will be distributed over the smooth undersurface of plate 1. Carpeting or sponge rubber 50 may be attached to the undersurface to prevent marring the ground plane. By lifting one end of the practice device fastened to the platform, the wheels will easily engage the ground for movement or transport.

Any number of methods may be used to fasten or position the practice device to the upper platform 21, such as the guides 26A and 26B along with a lever lock 27 or a combination thereof.

The drive motor 19 is protected above the upper platform by a housing 20, which also supports a panel or support for the electrical control switch 22 and the entrance of the electrical power cord 24.

Any number of methods may be used to control the drive motor circuit for stopping the drive motor 19 and cam arm 7 at its extremity of oscillation. One suggested method is by using a push-button switch mounted through the upper plate 21. Any other mechanically operated motion switch such as a micro-switch could be used in place of the push button. This push button would contact surfaces of the cam arm 7 and by opening a self-latching relay in the motor circuit, stop the drive at this position. As the self-latching relay is again activated by a mechanism which senses the firing at the ball, the cam arm 7 would make a 180° rotation until the opposite surface of the cam again is opened the micro-switch. When the operator of the device wishes to shut one unit down with the ON-OFF toggle switch, the self-latching motor-control relay would have its operating switch changed to another position 90° out of phase from the position of the micro-switch, and therefore the cam arm would be stopped when it has positioned the top and bottom platforms in alignment for storage.

Figure 8:
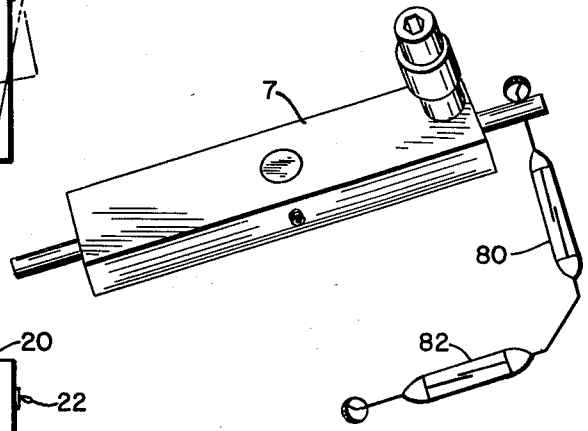
FIG. 8 shows some reed switches which may be used with a magnetic cam to limit the range of sweep when desired.
Figure 7:
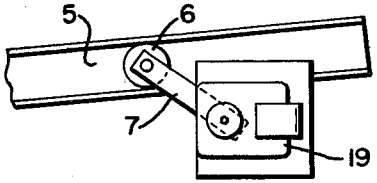
FIG. 7 is a top view of the motor and the cam operating in a slotted channel.
Figure 6:
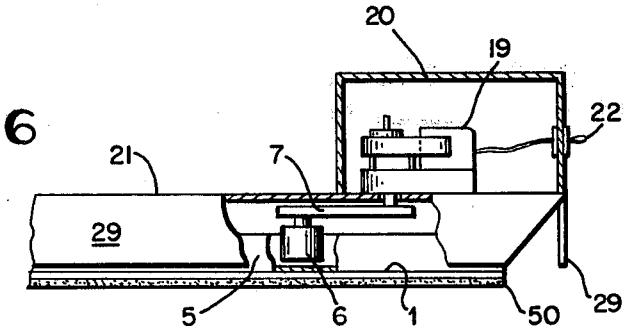
FIG. 6 is a partially cutaway view of the motor housing, showing the motor and cam cross-arm.

In one installation, shown in FIG. 8, the switches activated by the rotating cam arm 7 are sealed in glass reed switches 80 and 82, activated by magnets embedded in the cam arm 7. The reed switches are immune to dust and dirt, and activation entails no friction or wear problems.

What is claimed is:

1. An oscillating platform for a ball-throwing device comprising:

(a) a bottom plate having an upper and a lower surface, including a guide slot directly secured to said upper surface, (b) a pivot post affixed to the bottom plate substantially at the midpoint thereof, (c) an upper plate pivotally mounted on the pivot post, (d) a plurality of roller devices situated between the bottom plate and the upper plate for providing horizontal support for the upper plate while the upper plate pivots about the pivot post, (e) motive power means, mounted on said upper plate, for rotating the upper plate, (f) cam means offset from and driven by said motive power means and operably engaging said guide slot for causing the upper plate to oscillate in a predetermined arc about the pivot post, (g) means for releasably attaching said ball throwing device to the upper plate, and (h) a protective covering on the lower surface of said bottom plate for protecting the surface upon which said bottom plate rests during operation of said ball throwing device.

2. The platform according to claim 1, further comprising transport wheels mounted to said bottom plate and situated above the ground surface on which said bottom plate rests during normal operation of said ball throwing device and arranged for engagement with the ground surface upon lifting one end of said bottom plate.

3. The platform of claim 1 including arm means coupling said cam means to said motive power means and into operable engagement with said guide slot for causing said upper plate to oscillate in said predetermined arc.

4. The platform of claim 3 wherein said predetermined arc of oscillation is a function of the offset of said cam means from said motive power means.

5. The platform of claim 1 wherein said predetermined arc of oscillation is substantially equal to twice the offset of said cam means from said motive power means.

6. The platform of claim 1 including skirt means about the perimeter of said upper plate substantially enclosing said roller devices for preventing dirt particles from impeding pivotal movement of said upper plate.

7. The plate of claim 1 in combination with said ball throwing machine and said attaching means detachably mounting said machine relative to said upper platform.

* * * * *